US006422044B1

(12) United States Patent
Caselli et al.

(10) Patent No.: US 6,422,044 B1
(45) Date of Patent: Jul. 23, 2002

(54) NEEDLE ACTUATION DEVICE FOR KNITTING MACHINES FOR HOSIERY OR OTHER ARTICLES

(75) Inventors: Fernando Caselli, Pontassieve; Andrea Falchini, Impruneta; Filippo Bargellini, Fucecchio, all of (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 10/050,932

(22) Filed: Jan. 22, 2002

(30) Foreign Application Priority Data

Feb. 7, 2001 (IT) ..... MI01A0241

(51) Int. Cl.[7] ..... D04B 15/32
(52) U.S. Cl. ..... 66/54; 66/78
(58) Field of Search ..... 66/57, 38, 54, 66/71, 77, 78

(56) References Cited

U.S. PATENT DOCUMENTS 3,709,004 A * 1/1973 Paepke ..... 66/216
3,795,119 A * 3/1974 Bourgeois ..... 66/20
4,068,498 A * 1/1978 Bourgeois ..... 66/20
5,335,518 A * 8/1994 Lonati et al. ..... 66/108 R
5,682,770 A * 11/1997 Wang ..... 66/19
6,164,090 A * 12/2000 Lonati et al. ..... 66/57

* cited by examiner

*Primary Examiner*—Danny Worrell
(74) *Attorney, Agent, or Firm*—Guido Modiano; Albert Josif; Daniel O'Byrne

(57) ABSTRACT

A needle actuation device comprises a cam box facing a needle holder and supporting at least one lowering cam whose profile is inclined with respect to the direction of the motion of the needle holder with respect to the cam box. The profile of the lowering cam engageable by a needle or needle pusher heel, protruding from the needle holder. The lowering cam is movable along an adjustment direction in which at least one component is parallel to the direction of the sliding of the needles in the needle holder, to vary length of knitting loops, and rotatable to vary inclination of the profile with respect to the motion direction. Adjusters are provided to vary inclination of the profile of the lowering cam both correlated to the loop length variation and independently of the loop length variation.

13 Claims, 3 Drawing Sheets

NEEDLE ACTUATION DEVICE FOR KNITTING MACHINES FOR HOSIERY OR OTHER ARTICLES

BACKGROUND OF THE INVENTION

The present invention relates to a needle actuation device for knitting machines for hosiery or other articles.

It is known that knitting machines for hosiery or other articles are generally constituted by a needle holder, which can be substantially flat and straight or cylindrical, depending on whether the machine is of the rectilinear or circular type, and faces a cam box which supports a plurality of cams for actuating the needles during the operation of the machine.

More particularly, on the face of the needle holder that faces the cam box a plurality of mutually parallel slots are provided, each of which accommodates a needle and optionally a needle pusher. The needles, and optionally the needle pushers, are provided with heels which protrude from the needle holder toward the cam box so as to engage in paths defined by the cams. The needle holder, during the operation of the machine, is actuated along a direction of motion with respect to the cam box so that the heels of the needles or of the needle pushers engage in said paths, which have portions that are appropriately inclined with respect to the direction of motion in order to produce a reciprocating motion of the needles along the corresponding slots of the needle holder. This reciprocating movement causes the needles to take up the yarns supplied at one feed of the machine and form loops of knitting.

The cam that determines the movement of the needle, after the needle has engaged the yarn at a feed of the machine is termed lowering cam, since it causes a movement of the needle that forms a new loop of knitting, lowering the previously formed loop of knitting.

The lowering cam has a profile that can be engaged by the heels of the needles or of the needle pushers and is inclined with respect to the direction of motion of the needle holder with respect to the cam box indeed in order to achieve this movement of the needle.

In single-cylinder circular knitting machines for hosiery or other articles, in which the needle holder is constituted by the needle cylinder, the lowering cam, arranged directly after a feed or drop of the machine, causes the descent of the needles inside the slots formed on the lateral surface of the needle cylinder after said needles have engaged the yarn at the drop or feed.

In many kinds of knitting machine for hosiery or other articles, the lowering cam is mounted on a slider that can move on command, with respect to the cam box, along a direction that is parallel to the extension of the slots that accommodate the needles, so as to allow to vary the extent of the motion of the needles during the formation of new loops of knitting and therefore allow to vary the length of the loops of knitting.

In other kinds of machine, the lowering cam is fixed to the cam box, and the length of the loops of knitting is changed by moving the needle holder with respect to the cam box in a direction that is parallel to the extension of the slots that contain the needles.

The profile of the lowering cams currently used in knitting machines for hosiery or other articles has a relatively high inclination with respect to the direction of the motion of the needle holder relative to the cam box. This high inclination is necessary because during the formation of very long loops of knitting the yarn must rest on a small number of sinkers or regions of the needle holder in order to reduce the friction that contrasts the sliding of the yarn during the formation of the new loops. Said friction, if excessively high, might lead to the breaking of the yarn or to stretching of the loops formed previously on the same row of knitting. This high inclination, which is necessary in the knitting of long loops, prevents any increase in the operating speed of the machine, since it would cause rapid wear of the lowering cam and of the heels and might even break the heels of the needles or of the needle pushers.

In order to allow to increase the operating speed of the machine at least during the knitting of short loops, a device has been proposed which is the subject of U.S. Pat. No. 6,164,090 by the same Applicant and in which the lowering cam can rotate about an axis that is perpendicular to the surface of the portion of the needle holder that in each instance faces the cam box, so as to be able to vary the inclination of the profile of the lowering cam with respect to the direction of the motion of the needle holder with respect to the cam box.

This patent further provides for the possibility to obtain an automatic variation, particularly a reduction, of the inclination of the profile of the lowering cam when the lowering cam is moved with respect to the cam box in order to vary the length of the loops of knitting, particularly in order to reduce their length.

In the above cited patent, this automatic variation is obtained following a particular coupling of the lowering cam with the cam box and inevitably renders the inclination of the profile of the lowering cam dependent on the is length of the loops of knitting.

SUMMARY OF THE INVENTION

The aim of the present invention is to provide a needle actuation device for knitting machines for hosiery or other articles that allows, according to requirements, to vary the inclination of the profile of the lowering cam both in a manner that is correlated to the variation of the length of the loops of knitting and in a manner that is independent of the variation of the length of the loops of knitting.

Within this aim, an object of the invention is to provide a device that is structurally simple and can be fitted on a wide range of knitting machines for hosiery or other articles.

This aim and these and other objects that will become better apparent hereinafter are achieved by a needle actuation device for knitting machines for hosiery or other articles, comprising a cam box which faces a needle holder and supports at least one lowering cam whose profile is inclined with respect to the direction of the motion of said needle holder with respect to said cam box; said profile of the lowering cam being engageable by a heel of the needles or of needle pushers which protrudes from said needle holder toward said cam box; said needle holder having, on its face that faces said cam box, a plurality of slots that are parallel to each other and lie substantially at right angles to said direction of motion, each slot accommodating a needle that can slide along the corresponding slot; said lowering cam profile being suitable to produce a movement of the needles along the corresponding slot of the needle holder after engaging the yarn at a feed of the machine, in order to form new loops of knitting, lowering the previously formed loops of knitting, said lowering cam being supported by said cam box so that it can rotate about a rotation axis that is substantially perpendicular to the surface of the portion of said needle holder that in each instance faces said cam box, characterized in that it comprises first means for adjusting the position of said lowering cam with respect to said needle holder along an adjustment direction in which at least one component is parallel to the direction of the sliding of the needles that in each instance engage said lowering cam along the corresponding slots of the needle holder, in order to vary the length of the loops of knitting, and, means for connecting a portion of said lowering cam that is spaced from said rotation axis to said cam box for a rotation of said lowering cam about said rotation axis with respect to said cam box as a consequence of the translational motion of said lowering cam along said adjustment direction with respect to said cam box; second adjustment means being provided which are connected to said lowering cam and can be actuated for a rotation of said lowering cam about said rotation axis with respect to said cam box, independently of the translational motion of said lowering cam along said adjustment direction with respect to said cam box.

BRIEF DESCRIPTION OF THE DRAWINGS

Further characteristics and advantages of the present invention will become better apparent from the following detailed description of two preferred but not exclusive embodiments thereof, illustrated only by way of non-limitative example in the accompanying drawings, wherein.

DESCRIPTION OF THE PREFERRED EMBODIMENTS

Figure 2:
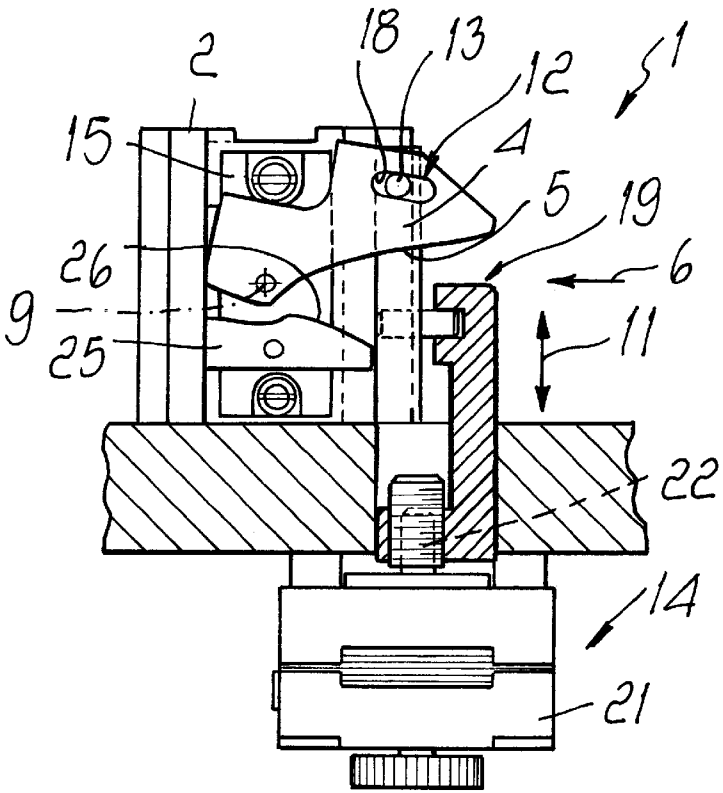
FIG. 2 is a cross-sectional view, similar to FIG. 1, of the device in the first embodiment, with the lowering cam in a second position.
Figure 1:
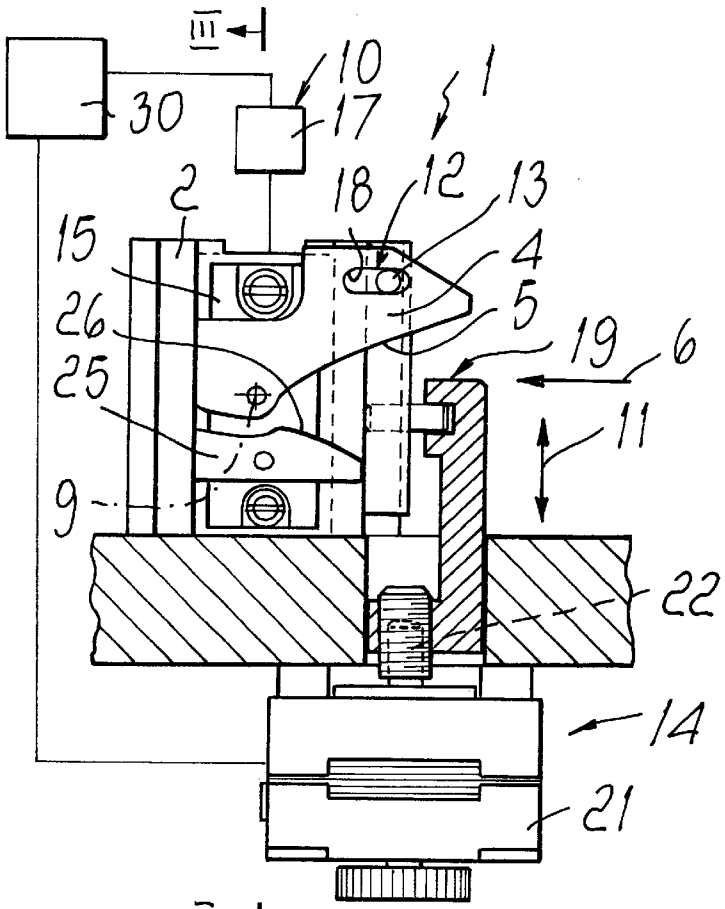
FIG. 1 is a cross-sectional view of the device according to the invention in its first embodiment, taken from the side arranged to be directed toward the needle holder of the machine, with the lowering cam in a first position.
Figure 6:
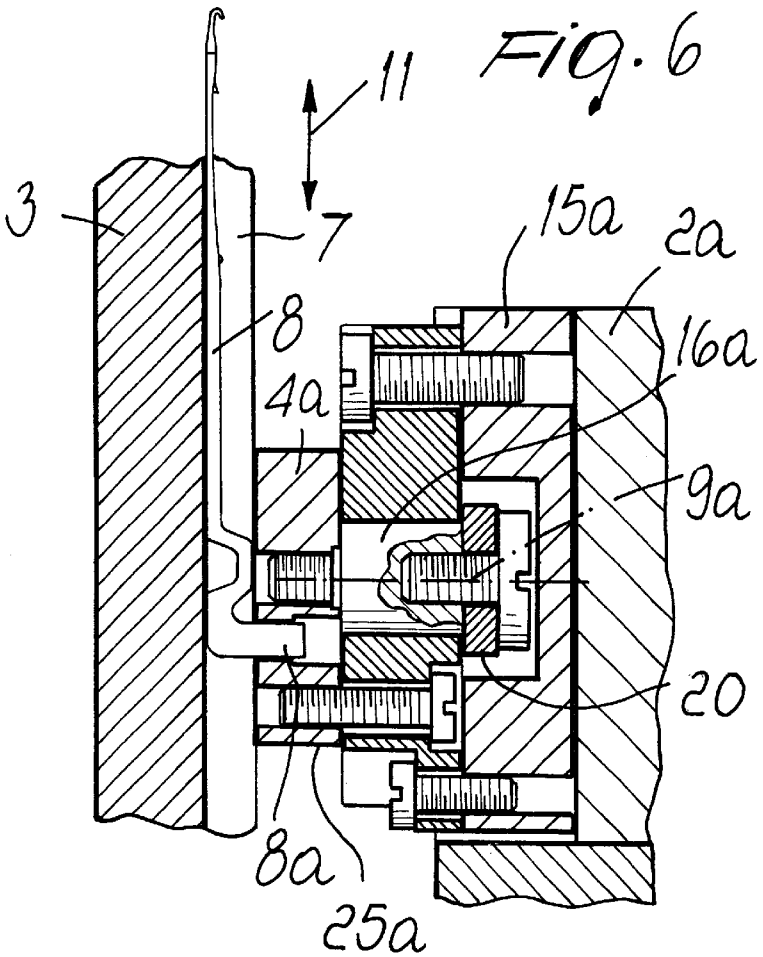
FIG. 6 is a cross-sectional view of the device of FIGS. 4 and 5, taken along the line VI—VI of FIG. 4, arranged so as to face the needle holder of the machine.
Figure 3:
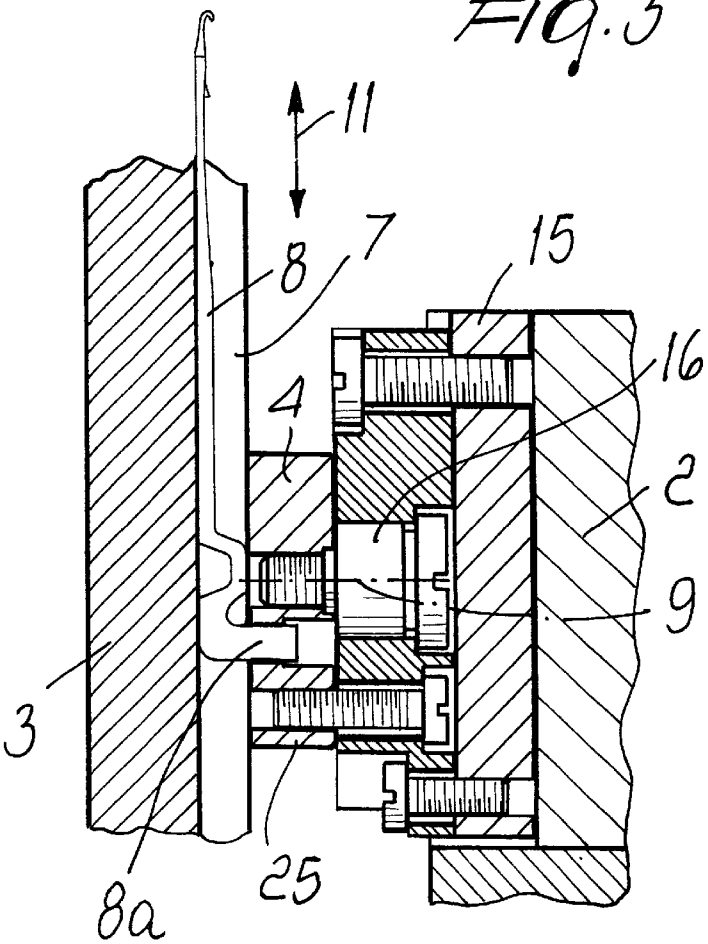
FIG. 3 is a cross-sectional view of the device of FIGS. 1 and 2, taken along the line III—III of FIG. 1, arranged so as to face the needle holder of the machine.
Figure 5:
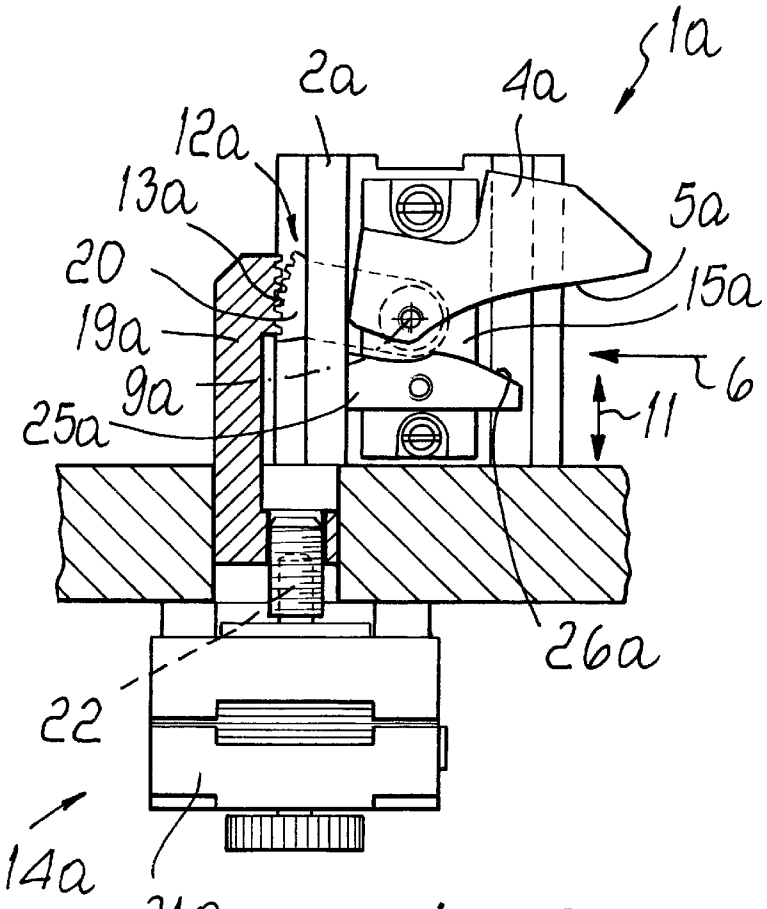
FIG. 5 is a cross-sectional view, similar to FIG. 4, of the device in its second embodiment, with the lowering cam in a second position.
Figure 4:
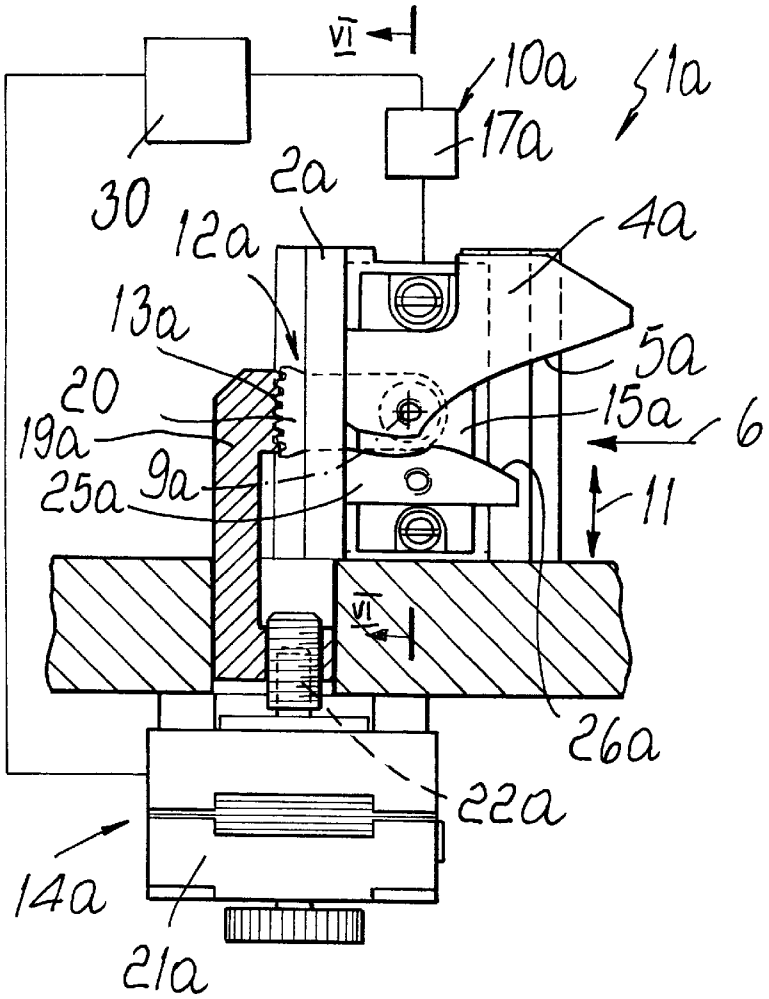
FIG. 4 is a cross-sectional view of the device according to the invention in a second embodiment, taken from the side arranged to be directed toward the needle holder of the machine, with the lowering cam in a first position.

With reference to the figures, the device according to the invention, generally designated by the reference numerals 1 and la in the two embodiments, comprises a cam box 2, 2*a,* which faces a needle holder 3 and supports at least one lowering cam 4, 4*a,* which has a profile 5, 5*a* that is inclined with respect to the direction 6 of the motion of the needle holder 3 with respect to the cam box 2, 2*a*.

The needle holder 3, depending on the machine on which the device according to the invention is meant to be fitted, can be substantially flat and rectilinear, as in the case of rectilinear knitting machines for hosiery or other articles, or can be cylindrical and constituted by the needle cylinder of a circular knitting machine for hosiery or other articles, or can be constituted by the dial of a circular knitting machine for hosiery or other articles of the cylinder and dial type.

On the face of the needle holder 3 that is directed toward the cam box 2, 2*a* there is a plurality of slots 7, which run parallel to each other and at right angles to the direction of motion 6.

Each slot 7 accommodates a needle 8, which can slide along the corresponding slot 7 and has a heel 8*a* that protrudes from the slot 7 and can engage the profile 5, 5*a* of the lowering cam 4, 4*a* and the other cams supported by the cam box 2, 2*a*.

It should be noted that the movement of the needle 8 along the corresponding slot 7, instead of being produced by means of the engagement of its heel 8*a* with the lowering cam 4, 4*a* and with the other cams associated with the cam box 2, can be obtained by means of a needle pusher, which is accommodated, together with the needle 8, inside a corresponding slot 7, and has a heel that can engage the profile 5, 5*a* of the lowering cam 4, 4*a* and the other cams that are supported by the cam box 2, 2*a*.

Thus, for example, if the machine that is equipped with the device according to the invention is a double-cylinder circular knitting machine for hosiery or other articles, the needle pushers are constituted by the sliders or transfer sinkers, which, by engaging by means of their heels the cams fitted on the cam box, cause the movement of the needle arranged in the same slot 7 of the needle cylinders.

The lowering cam 4, 4*a* is supported by the cam box 2, 2*a* so that it can rotate about a rotation axis 9, 9*a,* which is substantially perpendicular to the surface of the portion of the needle holder 3 that in each instance faces the cam box 2, 2*a*. The lowering cam 4, 4*a* can rotate about the rotation axis 9, 9*a* so as to vary the inclination of the profile 5, 5*a* with respect to the direction of motion 6.

According to the invention, the device comprises first means 10, 10*a* for adjusting the position of the lowering cam 4, 4*a* with respect to the needle holder 3 along an adjustment direction 11 in which at least one component is parallel to the direction of the sliding of he needles 8, which suitably engage the lowering cam 4, 4*a,* along the corresponding slots 7 of the needle holder 3, in order to vary the length of the loops of knitting. The device also comprises connection means 12, 12*a* for connecting a portion of the lowering cam 4, 4*a* that is spaced from the rotation axis 9, 9*a* to the cam box 2, 2*a* so that a translational motion of th lowering cam 4, 4*a* with respect to the cam box 2, 2*a* along the adjustment direction 11 can achieve automatically a rotation of the lowering cam 4, 4*a* about the rotation axis 9, 9*a* in order to vary the inclination of the profile 5, 5*a* with respect to the direction of motion 6. The device further comprises second adjustment means 14, 14*a,* which are connected to the lowering cam 4, 4*a* and can be actuated in order to produce a rotation of the lowering cam 4, 4*a* about the rotation axis 9, 9*a,* with respect to the cam box 2, 2*a,* independently of its translational motion, again with respect to the cam box 2, 2*a,* along the adjustment direction 11.

Preferably, the adjustment direction 11 is substantially parallel to the direction of the sliding of the needles 8 that suitably engage the lowering cam 4, 4*a* along the corresponding slots 7 of the needle holder 3.

The connection means 12, 12*a* are preferably connected to an abutment 13, 13*a,* which is supported in a movable manner by the cam box 2, 2*a*. Preferably, the abutment 13, 13*a* can slide with respect to the cam box 2, 2*a* along the adjustment direction 11.

Advantageously, the second adjustment means 14, 14*a* can be deactivated in order to lock the abutment 13, 13*a* rigidly to the cam box 2, 2*a* so as to achieve a rotation of the lowering cam 4, 4*a* about the rotation axis 9, 9*a* with respect to the cam box 2, 2*a* as a consequence of the translational motion of the lowering cam 4, 4*a* along the adjustment direction 11 with respect to the cam box 2, 2*a;* said means can be activated so as to move the abutment 13, 13*a* along the adjustment direction 11 with respect to the cam box 2, 2*a* in order to disengage the rotation of the lowering cam 4, 4*a* about the rotation axis 9, 9*a* from the translational motion of the lowering cam 4, 4*a* along the adjustment direction 11.

The first adjustment means 10, 10*a* comprise a slider 15, 15*a,* which is supported by the cam box 2, 2*a* so that it can slide along the adjustment direction 11. The lowering cam 4, 4*a* is pivoted to the slider 15, 15*a* by means of a rotatable pivot 16, 16*a,* whose axis defines the rotation axis 9, 9*a.*

The first adjustment means further comprise, in a per se known manner, an actuator, which is supported by the cam box 2, 2*a* and acts on command on the slider 15, 15*a* in order to produce its translational motion along the adjustment direction 11 with respect to the cam box 2, 2*a.* Said actuator is shown only schematically and can be constituted for example by a step motor 17, 17*a,* which is connected by means of the output shaft thereof to the slider 15, 15*a,* for example, by way of a connecting means such as a cam, or a screw-and-nut coupling, or a rack-and-pinion coupling.

In the first embodiment, the abutment 13 is constituted by a pivot that engages in a slot 18. The slot 18, which constitutes the above cited connection means 12, is formed in a region of the lowering cam 4, 4*a* that is spaced from the rotation axis 9. The pivot 13 is fixed to an arm 19, which is supported by the cam box 2 so as to be able to slide along the adjustment direction 11.

In the second embodiment, the abutment 13*a* is constituted by a rack, which meshes with a toothed sector 20 whose center lies on the rotation axis 9*a.* The toothed sector 20, which constitutes the above cited connection means 12*a,* is fixed to the pivot 16*a* and is thus rigidly coupled to the lowering cam 4*a* in its rotation about the axis 9*a* with respect to the cam box 2. The rack 13*a* is fixed, or better still formed, on an arm 19*a,* which is supported by the cam box 2*a* so as to be able to slide along the adjustment direction 11.

The second adjustment means 14, 14*a,* in both illustrated embodiments, preferably comprise a step motor 21, 21*a,* which is supported by the cam box 2, 2*a* and is connected by means of its output shaft 22, 22*a* to the arm 19, 19*a,* for example by means of a screw-and-nut coupling whose axis is parallel to the adjustment direction 11.

Conveniently, the first adjustment means 10, 10*a* and the second adjustment means 14, 14*a* are connected to a programmable electronic actuation and control element 30, which supervises the operation of the machine and controls the actuation of the first adjustment means 10, 10*a* and of the second adjustment means 14, 14*a* according to programs that are preset according to the types of knitting that the machine must perform.

For the sake of completeness in description, it should be noted that the cam box 2, 2*a* supports a complementary cam 25, 25*a,* whose profile 26, 26*a* faces the profile 5, 5*a* of the lowering cam 4, 4*a.*

The operation of the device according to the invention is as follows.

If one wishes to achieve automatically a variation of the inclination of the profile 5, 5*a* of the lowering cam 4, 4*a* with respect to the direction of motion 6 as the length of the loops of knitting varies, the second adjustment means 14, 14*a* are not actuated; i.e., the step motors 21, 21*a* are not actuated. In this manner, the abutment 13, 13*a* remains rigidly coupled to the cam box 2, 2*a,* and by being connected, by means of the slot 18 or the toothed sector 20, to a portion of the lowering cam 4, 4*a,* when said cam is moved along the adjustment direction 11 with respect to the cam box 2, 2*a* by the first adjustment means 10, 10*a,* it causes the rotation of the lowering cam 4, 4*a* about the axis 9, 9*a,* thus varying the inclination of the profile 5, 5*a* with respect to the direction of motion 6 proportionally to the movement of the lowering cam 4, 4*a* along the adjustment direction 11.

In particular, the connection between the lowering cam 4, 4*a* and the abutment 13, 13*a* is such as to reduce the inclination of the profile 5, 5*a* when the length of the loops of knitting is decreased.

If one instead wishes to render the inclination of the profile 5, 5*a* of the lowering cam 4, 4*a* independent of the movement of the lowering cam 4, 4*a* along the adjustment direction 11, the second adjustment means, i.e., the step motors 21, 21*a,* are activated. The step motors 21, 21*a* produce the translational motion of the abutment 13, 13*a* and accordingly a rotation of the lowering cam 4, 4*a* about the rotation axis 9, 9*a* with respect to the cam box 2 2*a.*

It should be noted that if the first adjustment means and the second adjustment means are both actuated, the extent of the rotation of the lowering cam 4, 4*a* depends on the difference of the movements of the slider 15, 15*a* and of the abutment 13, 13*a* along the adjustment direction 11. In particular, if one does not wish to vary the inclination of the profile 5, 5*a* of the lowering cam 4, 4*a* as the length of the loops varies, it is sufficient to actuate the first adjustment means 10, 10*a* and the second adjustment means 14, 14*a* so that the abutment 13, 13*a* performs a translational motion rigidly with the slider 15, 15*a.*

In practice, it has been observed that the device according to the invention fully achieves the intended aim and objects, since according to the knitting requirements it allows to vary the inclination of the profile of the lowering cam both in a manner that is correlated to the variation of the length of the loops of knitting and in a manner that is independent of the variation of the length of the loops of knitting.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2001A000241 from which this application claims priority are incorporated herein by reference.

What is claimed is:

1. A needle actuation device for a knitting machine having a needle holder, needles and needle pushers provided with respective heels, a yam feeder, comprising: a cam box facing the needle holder; at least one lowering cam supported at said cam box and having a profile which is inclined with respect to a motion direction of said needle holder with respect to said cam box, said lowering cam profile being engageable by any of the heels of the needles and needle pushers which protrude from said needle holder toward said cam box, said needle holder having, on a face thereof that faces said cam box, a plurality of accommodation slots that are parallel to each other and lie substantially at right angles to said motion direction, each said slot accommodating a respective one of said needles so as to be slideable along a corresponding accommodation slot, said lowering cam profile being shaped so as to produce movement of each one of said needles along a sliding direction defined by the corresponding accommodation slot of the needle holder after engaging yarn at the feed of the machine, in order to form new loops of knitting, by lowering previously formed loops of knitting, said lowering cam being supported by said cam box so as to rotate about a rotation axis that is substantially perpendicular to a surface portion of said needle holder that faces said cam box; first adjustment means for adjusting a position of said lowering cam with respect to said needle holder along an adjustment direction with at least one component which is parallel to the sliding direction of the needles that engage said lowering cam along the corresponding accommodation slots of the needle holder, in order to vary loop lengths; connecting means for connecting a portion of said lowering cam that is spaced from said rotation axis to said cam box for a rotation of said lowering cam about said rotation axis with respect to said cam box as a consequence of translational motion of said lowering cam along said adjustment direction with respect to said cam box; and second adjustment means which are connected to said lowering cam, said second adjustment means being actuatable for causing rotation of said lowering cam about said rotation axis with respect to said cam box, independently of the translational motion of said lowering cam along said adjustment direction with respect to said cam box.

2. The device of claim 1, further comprising an abutment which is supported by said cam box and is movable with respect to said cam box, said connection means being connected to said abutment, said abutment being further connected to said second adjustment means, and said second adjustment means being both deactivatable in order to lock said abutment with respect to said cam box for rotation of said lowering cam, about said rotation axis, with respect to said cam box as a consequence of the translational motion of said lowering cam along said adjustment direction with respect to said cam box, and activatable in order to move said abutment with respect to said cam box for rotation disengagement of said lowering cam about said rotation axis from said translational motion of the lowering cam.

3. The device of claim 2, wherein said adjustment direction is substantially parallel to the sliding direction of the needles that engage said lowering cam along the corresponding slots of the needle holder.

4. The device of claim 2, wherein said abutment is supported by said cam box so as to be slideable along an abutment sliding direction that is substantially parallel to said adjustment direction.

5. The device of claim 3, wherein said first adjustment means comprises an adjustment slider, which is supported by said cam box so as to be slideable along said adjustment direction, said adjustment slider supporting said lowering cam so as to be rotatable about said rotation axis.

6. The device of claim 5, further comprising an arm which is supported by said cam box so as to be slideable along said adjustment direction, and a slot formed in a region of said lowering cam that is spaced from said rotation axis, said abutment being constituted by a pivot which engages said slot, and said pivot being mounted on said arm.

7. The device of claim 5, further comprising: an arm which is supported by said cam box so as to be slideable along said adjustment direction, and a toothed sector centered on said rotation axis and rigidly coupled to said lowering cam; said abutment being constituted by a rack, which meshes with said toothed sector, said rack being mounted on said arm.

8. The device of claim 5, wherein said second adjustment means comprises a step motor with an output shaft, said step motor being supported by said cam box and connected to said arm by way of said output shaft thereof.

9. The device of claim 5, wherein said first adjustment means comprises a step motor with an output shaft, said step motor being supported by said cam box and connected to said adjustment slider by way of said output shaft thereof.

10. The device of claim 1, further comprising an electronic control and actuation element, which is connected to, and programmable for controlling actuation of said first adjustment means and of said second adjustment means, according to preset programs.

11. The device of claim 1, wherein said knitting machine is circular, and said needle holder is constituted by a needle cylinder of said circular knitting machine.

12. The device of claim 1, wherein said knitting machine is circular, and said needle holder is constituted by a dial of said circular knitting machine.

13. The device of claim 1, wherein said knitting machine is circular and of a double-cylinder type, said needle pushers being constituted by sliders of said circular knitting machine.

* * * * *